US007125286B2

(12) United States Patent
Wang et al.

(10) Patent No.: US 7,125,286 B2
(45) Date of Patent: Oct. 24, 2006

(54) ELECTRICAL CONNECTOR AND METHOD OF MAKING THE SAME

(75) Inventors: Diangang Wang, Kunsan (CN); Nick Lin, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/934,855

(22) Filed: Sep. 3, 2004

(65) Prior Publication Data

US 2005/0048849 A1 Mar. 3, 2005

(30) Foreign Application Priority Data

Sep. 3, 2003 (TW) ..... 92124289 A

(51) Int. Cl.
*H01R 24/00* (2006.01)

(52) U.S. Cl. ..... 439/637; 439/736; 439/733.1

(58) Field of Classification Search ..... 439/637, 439/736, 733.1
See application file for complete search history.

(56) References Cited

U.S. PATENT DOCUMENTS

| | | | | | |
|---|---|---|---|---|---|
| 4,286,837 | A * | 9/1981 | Yasutake et al. | ..... | 439/637 |
| 4,602,831 | A * | 7/1986 | Lockard | ..... | 439/108 |
| 5,409,404 | A * | 4/1995 | Reed | ..... | 439/736 |
| 5,836,792 | A * | 11/1998 | Thumma et al. | ..... | 439/736 |
| 6,007,387 | A * | 12/1999 | Uchiyama | ..... | 439/736 |
| 6,206,735 | B1 * | 3/2001 | Zanolli | ..... | 439/736 |
| 6,290,552 | B1 * | 9/2001 | Saito et al. | ..... | 439/736 |

* cited by examiner

*Primary Examiner*—Hae Moon Hyeon
(74) *Attorney, Agent, or Firm*—Wei Te Chung

(57) ABSTRACT

An electrical connector includes a dielectric housing and a number of contacts. One side of the dielectric housing defines a number of passageways for receiving the contacts. The contact includes a retention portion to secure the contact in the dielectric housing. The retention portion defines at least one through hole in the center. The housing is stamped and a corresponding number of projecting portions are extruded into the through holes after the contacts are inserted into the housing, thereby securing the contacts in the housing.

11 Claims, 9 Drawing Sheets

ELECTRICAL CONNECTOR AND METHOD OF MAKING THE SAME

BACKGROUND OF THE INVENTION

1. Field of the Invention

The present invention relates to an art of electrical connectors, more specifically, to an electrical connector for electrically connecting a memory module or the like to a printed circuit board (PCB).

2. Description of Related Art

With the development of electronic industry, performance of an electrical connector is increasingly required. As a result, the structure of the connector turns to be increasingly complex and manufacturing of the electrical connector becomes increasingly difficult. For example, in order to prevent terminals from loosening in a housing of the electrical connector, a conventional technology is provided to stamp one side of the housing where the terminal is secured nearby. Therefore, an interference between the terminal and the housing is gained by proper deformation of the housing by stamping, which provide a firm securing of the terminal in the housing.

Referring to FIGS. 8–14, a conventional electrical connector for connecting a memory module to a PCB is shown. The electrical connector includes a longitudinal dielectric housing 60 and a number of terminals 70 received in the housing 60. The housing 60 defines a lengthwise inserting face 61, an bottom face 62 opposite to the inserting face 61, and two opposite side walls 63 perpendicular to both the inserting face 61 and bottom face 62. A number of receiving holes 65 cut through housing 60 from inserting face 61 to bottom face 62. Each receiving hole 65 is defined with a first mating surface 651 and a second mating surface 652, both parallel to the side face 63, and the first mating surface 651 closer to the side face 63. The terminal 70 includes a sheet-like retention portion 72, an arcuate contacting portion 74 extending upwardly from an upper end of the retention portion 72 and an inserting portion 76 extending downwardly from a lower end of the retention portion 72. The retention portion 72 protrudes a pair of stoppers 78 along two opposite lateral sides of the retention portion 72. The stoppers 78 are used to control the depth of the terminal 70 inserted into the housing 60. Furthermore, the retention portion 72 has a first and a second retention faces 721, 722 for interferentially mating with the first and second mating surfaces 651, 652, respectively. The contacting portion 74 is used for contacting a golden finger of a memory module or the like. The inserting portion 76 is soldered to a PCB.

In assembling the electrical connector, insert the terminals 70 through the inserting face 61 into the receiving holes 65 until the stoppers 78 are blocked against the housing 60, mount the connector onto the PCB, the inserting portion 76 of the terminal 70 being inserted into a hole (not shown) defined beforehand in a PCB corresponding to the terminal 70, solder the inserting portion 76 to the PCB, so electrical connection between the electrical connector and the PCB is defined.

However, in said assembling, all the terminals 70 of the connector need to be inserted into corresponding holes in the PCB at the same time, and it is impossible to align all the terminals 70 to corresponding holes synchronously, so some of the terminals 70, which are deflected from corresponding holes in the PCB, tend to draw back and even release from the housing 60 during the insertion, which will negatively effect the electrical connection between the electrical connector and the PCB. In order to insure the quality of the electrical connection between the electrical connector and the PCB, the retention forces of the terminals 70 need to be increased.

To increase the retention forces of the terminals 70 in the receiving holes 65, a conventional technology is to dimple a line of dents 69 equidistantly arranged on the side face 63 of the housing 60. With the dents deflecting the side face 63, the first mating surfaces 651 displace inwardly partly. So the amount of an interference between the terminals 70 and the first mating surface 651 increases and the force of the housing 60 gripping the contact 70 increases accordingly. In order to further improve the retention forces of the terminals 70 in the receiving holes 65, conventionally, a number of protrusions 7211 are stamped out on the first retention face 721 of the retention portion 72 to increase the amount of the interference between the terminal 70 and the housing 60.

However, when the retention portion 72 is stamped out the protrusion 7211 on the first retention face 721, there is always a recess 7222 defined on the second retention face 722. So when the first mating surface 651 is stamped towards the first retention face 721 of the terminal 70, the protrusions 7211 are usually pressed down, and thus, the retention force of the terminal 70 in the housing 60 is impaired.

SUMMERY OF THE INVENTION

Accordingly, the object of the present invention is to provide an electrical connector with a firm retention between a contact and a housing thereof.

Another object of the present invention is to provide a method to make an electrical connector with a firm retention between a contact and a housing thereof.

In order to achieve the above-mentioned objects, an electrical connector in accordance with a preferred embodiment of the present invention is provided. The electrical connector includes a dielectric housing and a number of contacts. The dielectric housing defines a number of passageways for receiving the contacts. The contact includes a retention portion to fasten itself in the dielectric housing. The retention portion further defines at least one through hole in the center. The housing is stamped and a number of projecting portion is extruded into corresponding through holes inside the passageways, thereby securing the contacts therein.

Other objects, advantages and novel features of the invention will become more apparent from the following detailed description when taken in conjunction with the accompanying drawings, in which:

DETAILED DESCRIPTION OF PREFERRED EMBODIMENT OF THE INVENTION

Reference will now be made to the drawings to describe the present invention in details.

Figure 1:
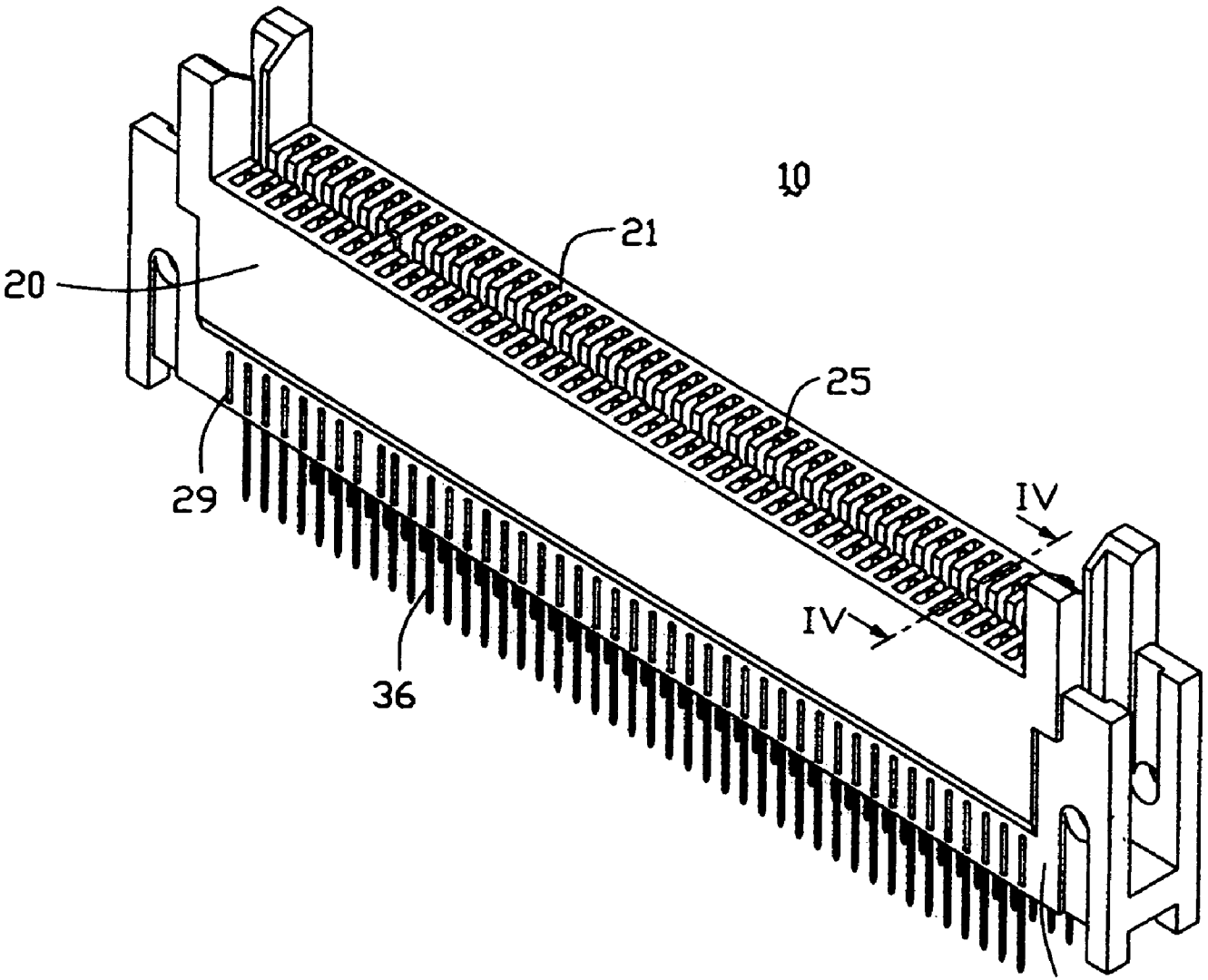
FIG. 1 is an isometric view of an electrical connector in accordance with a preferred embodiment of the present invention.
Figure 2:
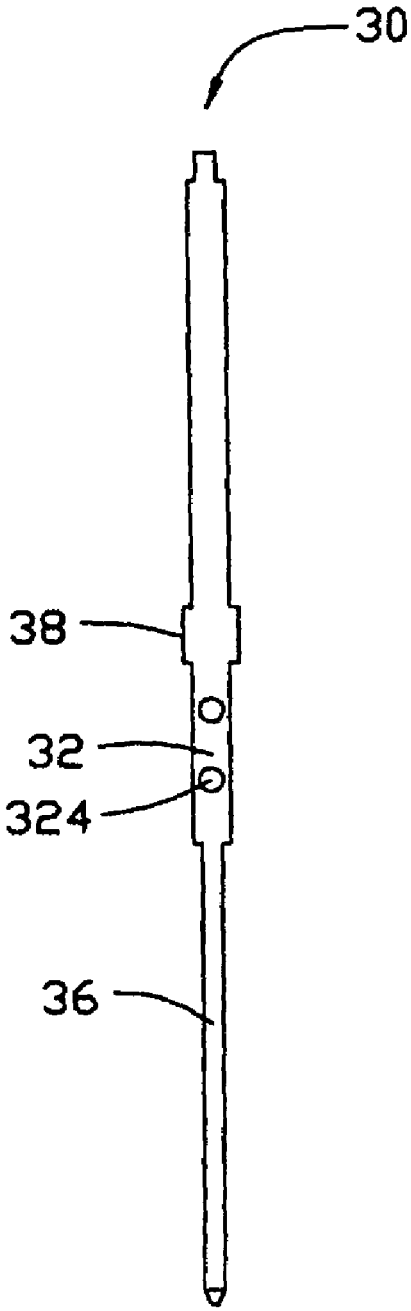
FIG. 2 is an front view of a contact of the electrical connector.
Figure 3:
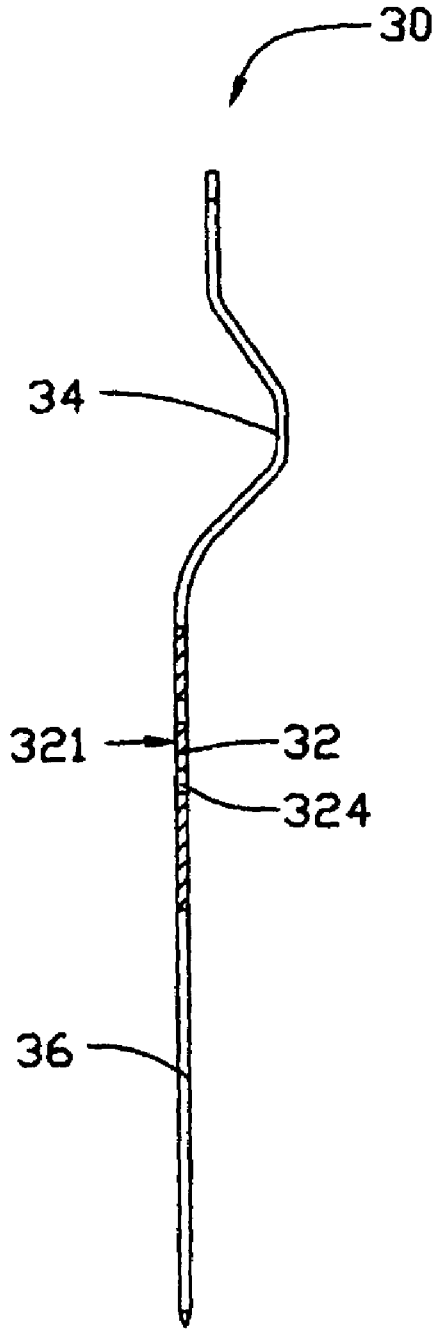
FIG. 3 is a left broken section of the contact of FIG. 2.

Referring to FIG. 1, an electrical connector 10 in accordance with a preferred embodiment of the present invention is shown. The connector 10 is mainly used for connecting a memory module (not shown) or the like to a PCB (not shown). The connector 10 includes a longitudinal dielectric housing 20 and a number of contacts 30 received therein.

Figure 4:
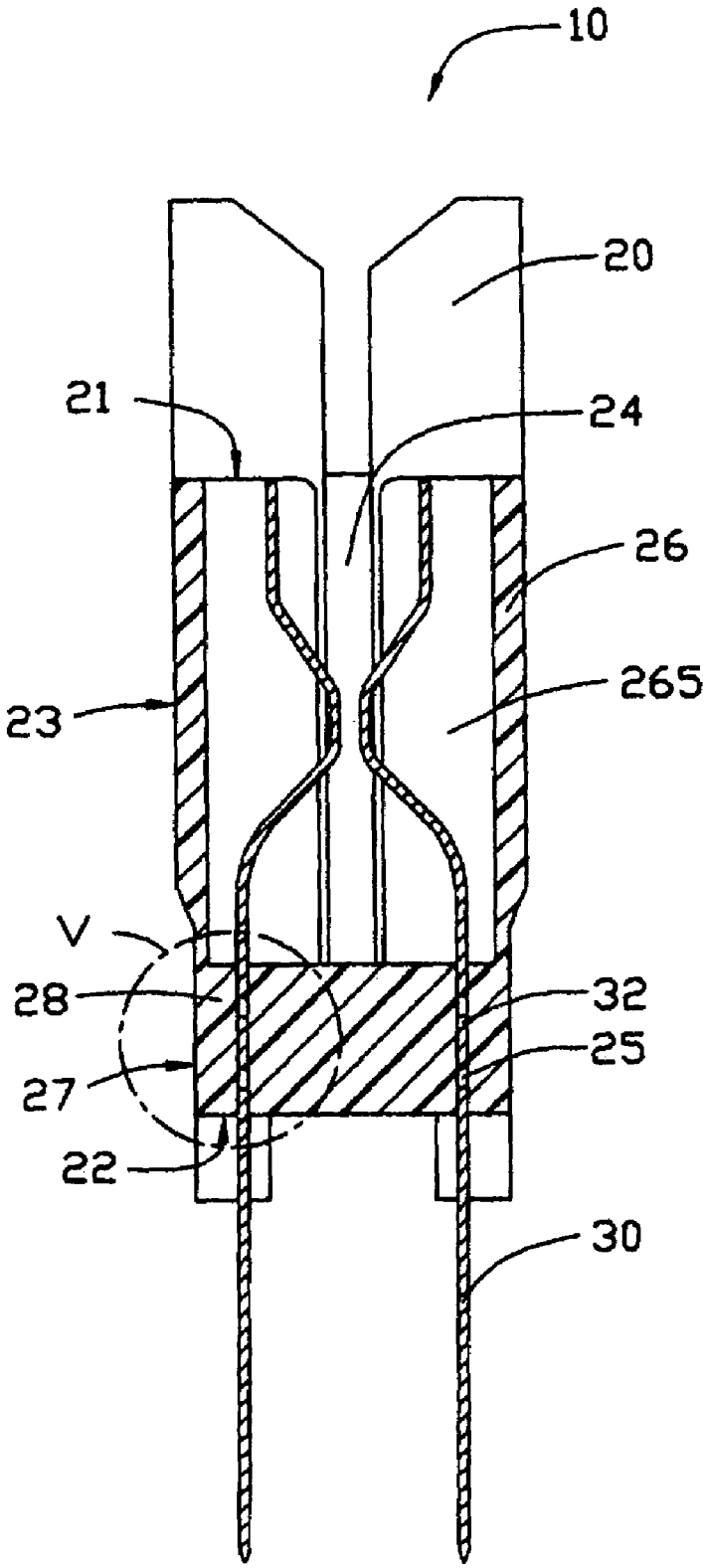
FIG. 4 is a cross-sectional view of the electrical connector of FIG. 1 taken along a line IV—IV before the electrical connector is stamped.
Figure 5:
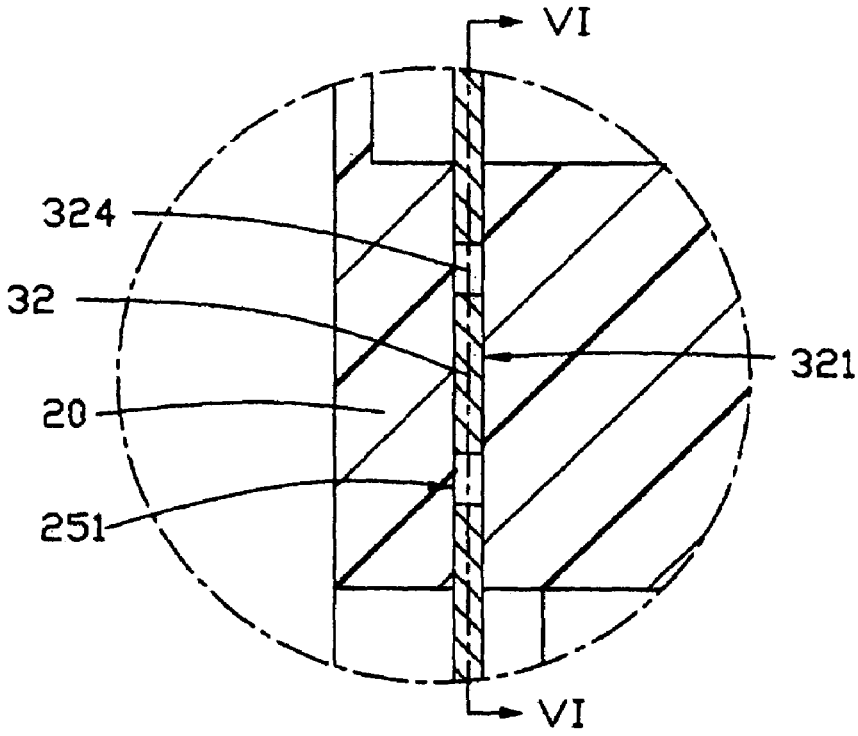
FIG. 5 is an enlarged view of a circled part V of FIG. 4.
Figure 6:
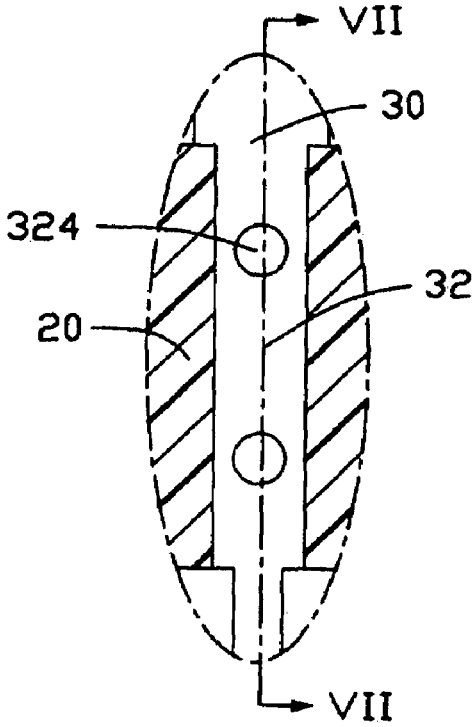
FIG. 6 a cross-sectional view taken along a line VI—VI of FIG. 5.
Figure 7:
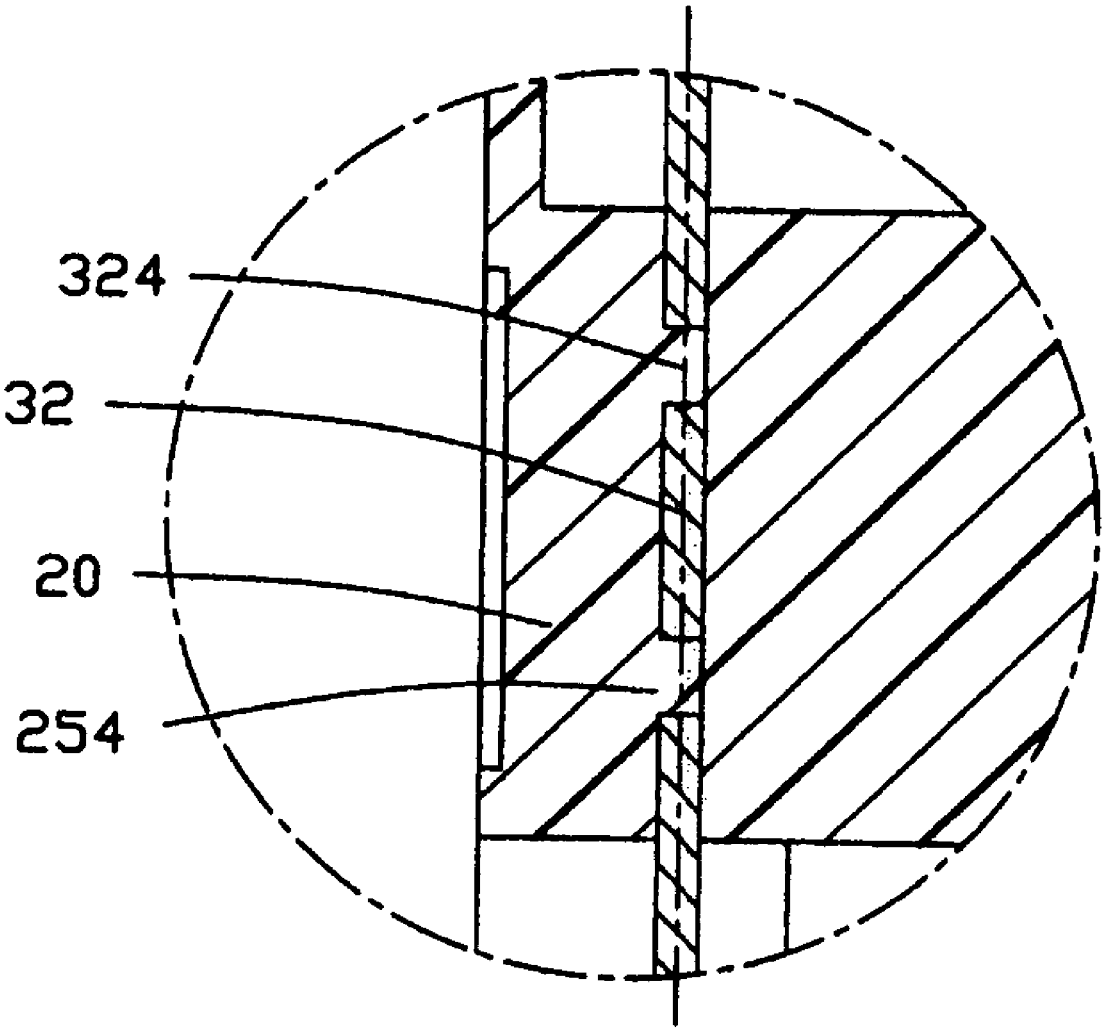
FIG. 7 is a similar view as FIG. 5 but protrusions are extruded into through holes of the contacts.
Figure 8:
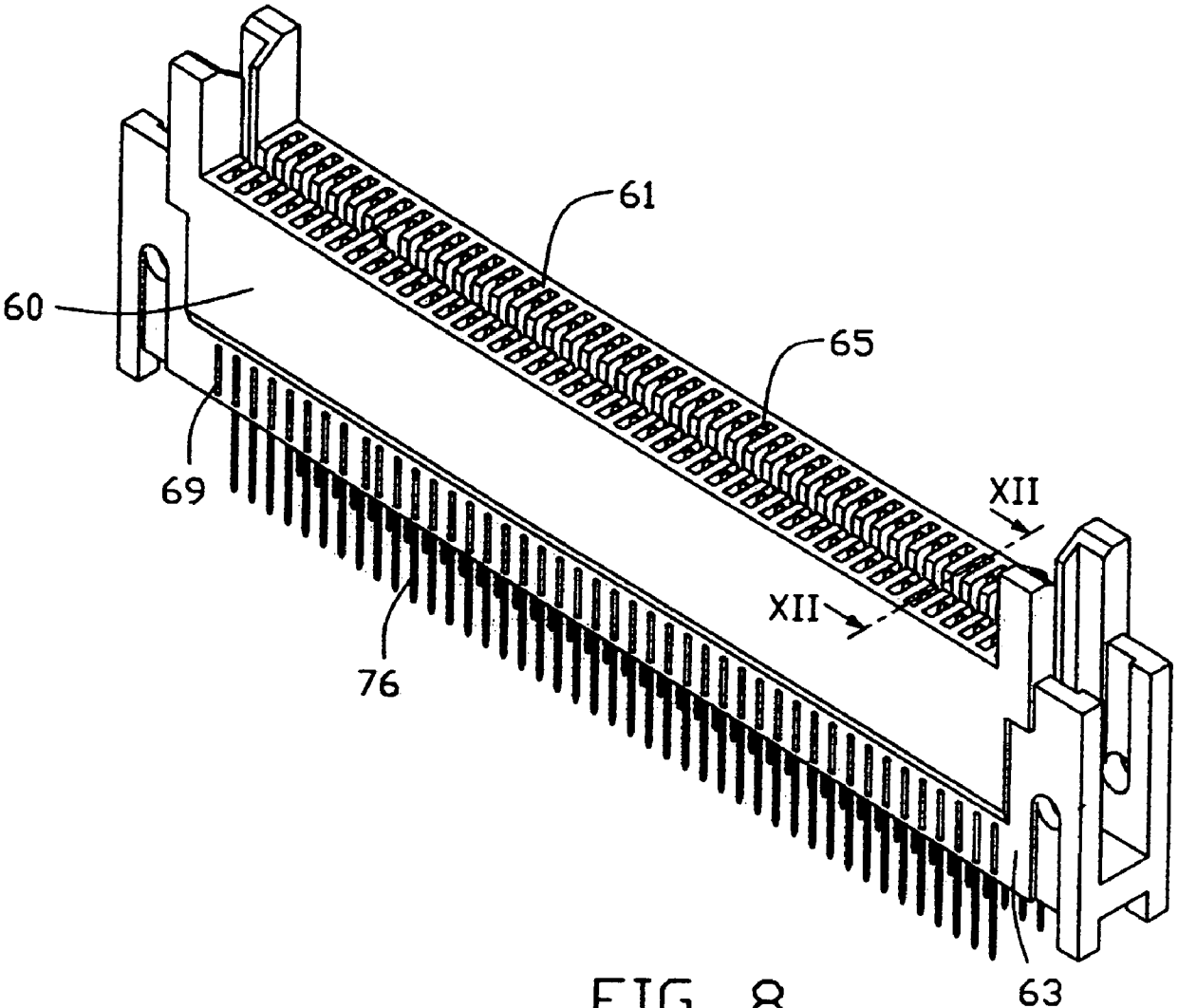
FIG. 8 (PRIOR ART)
FIG. 8 is an isometric view of a conventional electrical connector related to the present invention.
Figure 9:
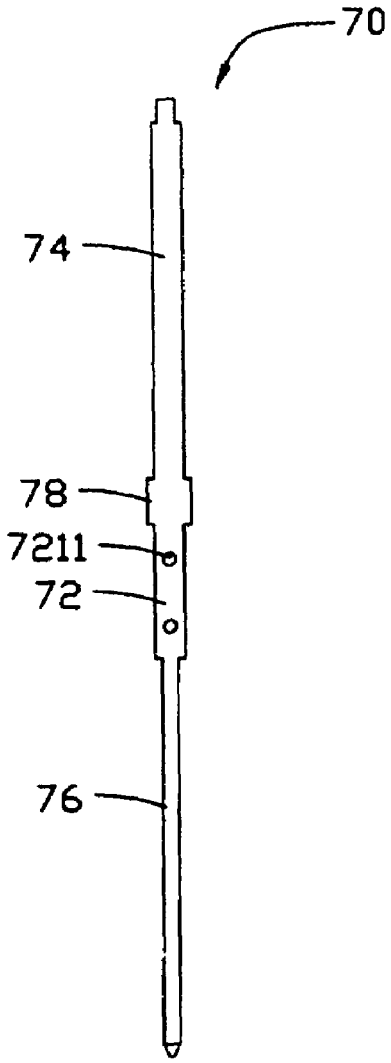
FIG. 9 (PRIOR ART)
FIG. 9 is a front view of a terminal of the conventional electrical connector shown in FIG. 7.
Figure 10:
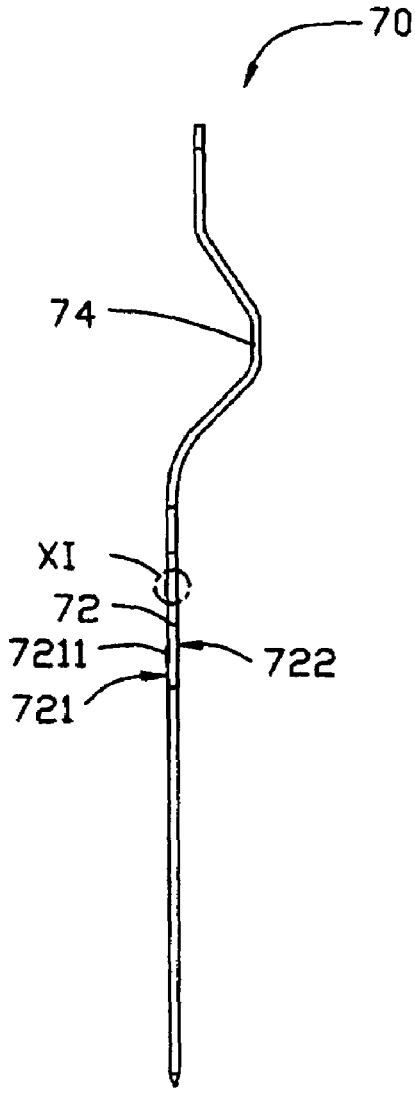
FIG. 10 (PRIOR ART)
FIG. 10 is a left view of the terminal of FIG. 9.
Figure 11:
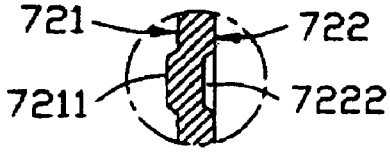
FIG. 11 (PRIOR ART)
FIG. 11 is an enlarged cross-sectional view of a circled part XI of FIG. 10.
Figure 12:
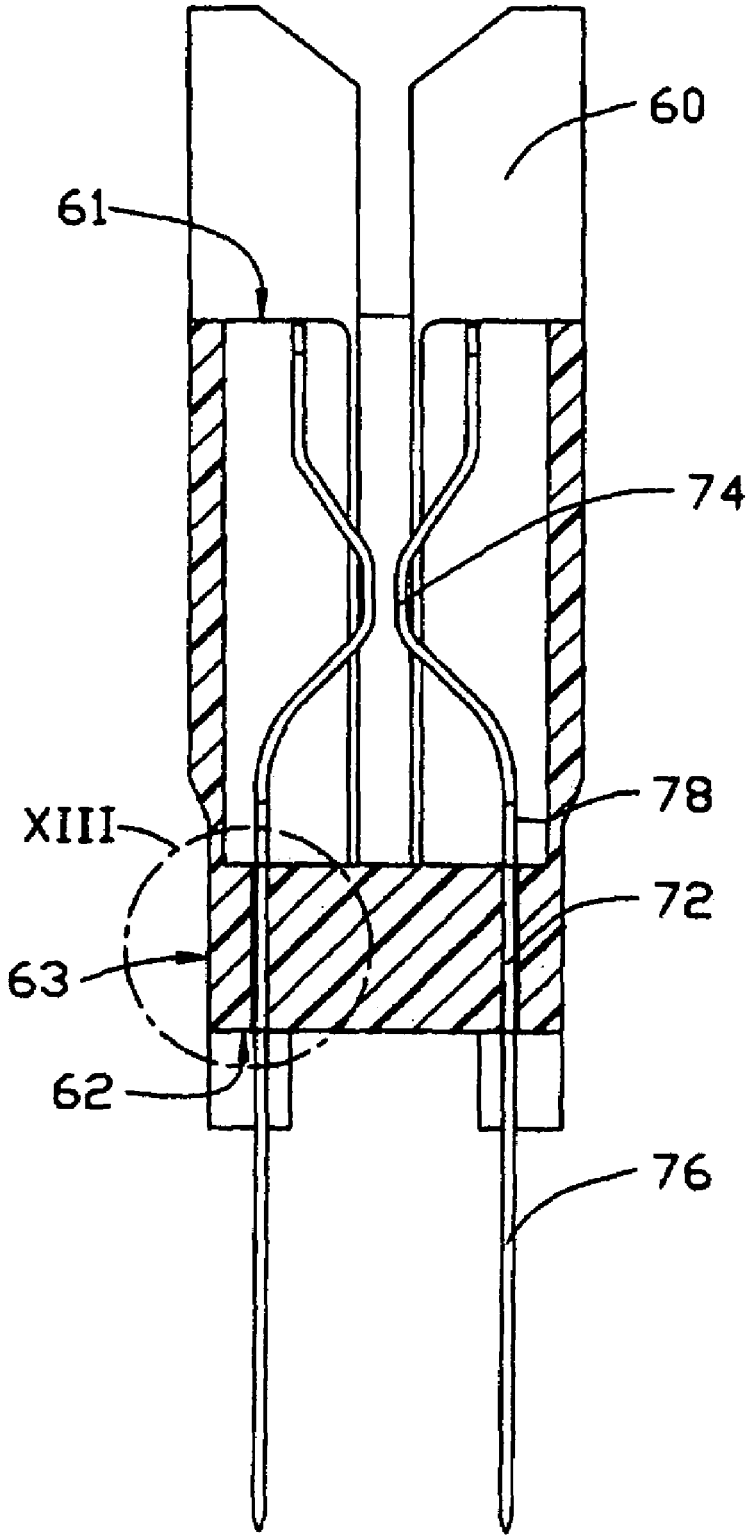
FIG. 12 (PRIOR ART)
FIG. 12 is a cross-sectional view along line of XII—XII of FIG. 8 before the electrical connector is stamped.
Figure 13:
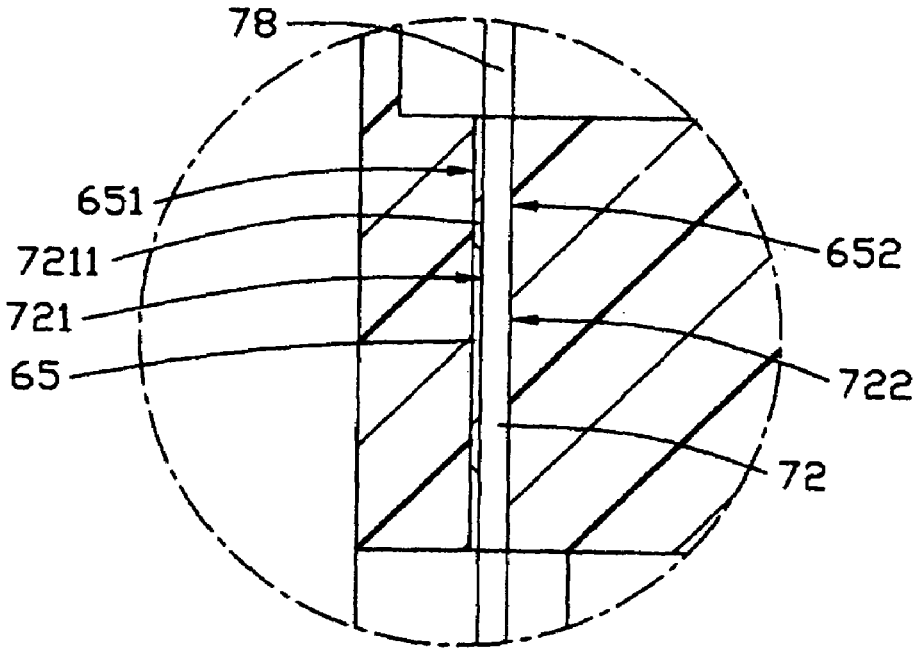
FIG. 13 (PRIOR ART)
FIG. 13 is an enlarged view of a circled part XIII of FIG. 12 before the connector is stamped.
Figure 14:
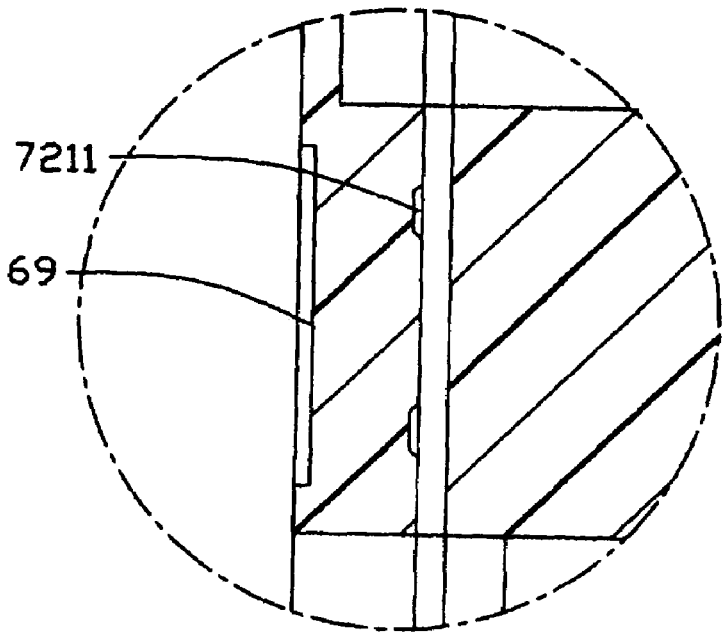
FIG. 14 (PRIOR ART)
FIG. 14 is similar to FIG. 12, but showing the connector post stamped.

Referring to FIGS. 1, 4 and 5, the dielectric housing 20 defines a mounting surface 22, an inserting surface 21 opposite to the mounting surface 22 and a first outside face 23 perpendicular to both the mounting surface 22 and the inserting surface 21. There is a second outside face 27 connected parallel to the first outside face 23 by a step. A lengthwise trench 24 for receiving the memory module is defined in the middle of the inserting surface 21. The housing 20 forms a longitudinal bottom wall 28 and two side walls 26 generally perpendicularly to the bottom wall 28 and parallel to a longitudinal direction of the housing 20. The trench 24 is defined by the bottom wall 28 and two side walls 26. Near the second outside face 27, the bottom wall 28 defines two lines of passageways 25 equidistantly arranged along and in communication with the trench 24, the passageways 25 cutting through the bottom wall 28. Each of the passageways 25 defines two opposite mating surfaces 251 parallel to the second outside face 27. Either of the side walls 26 defines a line of opens 265 communicating the stretch 24 and corresponding passageways 25, the opens extending from the inserting surface 21 to the bottom wall 28.

Referring to FIGS. 2, 3, 4 and 5, each of contacts 30 is secured in the housing 20. The contact 30 includes a sheet-like retention portion 32, an arcuate contacting portion 34, a pair of orientation portion 38 and an inserting portion 36. The retention portion 32 is used for mating with the passageways 25 for securing the contact 30 in the housing 20. The retention portion 32 is formed with two opposite retention surfaces 321 to mate with the mating surfaces 251 respectively. The retention portion 32 further defines two through holes 324 cutting through the center of the retention surfaces 321 perpendicularly. The contacting portion 34 extends upwardly from a upper end of the retention portion 32 for contacting the memory module. The orientation portions 38 extends laterally from a joint between the retention portion 32 and the contacting portion 34. The inserting portion 36 extends downwardly from the lower end of the retention portion 32 out of the housing 20 for being mounted on a printed circuit board in a through-hole fashion.

Referring to FIGS. 1–6, in assembling the connector 10, provide a housing 20 and a number of contacts 30 as described above, insert the contacts 30 into corresponding passageways 25 through the inserting surface 21 till orientation portions 38 reach the bottom wall 28, stamp the second outside face 27 of the housing 20 corresponding to the through holes 324 of the contact 30, consequently, a line of dents 29 left, parts of the housing 20 extruded into the through holes 324 to form projecting portions 254. Thereby, the contact 30 is firmly secured in the housing 20 by the cooperation of the projecting portions 254 and the through holes 324.

If the through holes 324 are substituted by grooves symmetrically defined by the opposite lateral sides of the retention portion 32, the number of the dents stamped on the second outside face 27 should double, which will increases the damage to the housing 20.

While preferred embodiment in accordance with the present invention has been shown and described, equivalent modifications and changes known to persons skilled in the art according to the spirit of the present invention are considered within the scope of the present invention as defined in the appended claims.

What is claimed is:

1. An electrical connector for connecting an electrical device to a printed circuit board, comprising:

a dielectric housing defining a plurality of passageways;

a plurality of contacts received in the passageways, each of the contacts forming a retention portion for securing the contact in the housing, the retention portion defining at least one through holes in the center thereof;

wherein the housing defines an outside the adjacent to the passageways, on which the housing is conveniently stamped on to extrude parts of the housing to form at least one projecting portion inside the passageway, the at least one projecting portion mating into the at least one through hole to secure the contact in the housing.

2. The electrical connector as claimed in claim 1, wherein each of the passageways defines a mating surface parallel to the outside face, said retention portion defines a retention surface for mating with said mating surface, and said through holes defined in the center of the retention surface.

3. The electrical connector as claimed in claim 2, wherein the housing further defines an inserting surface substantially perpendicular to the outside face and a longitudinal trench in the inserting surface, the passageways being arranged along and communicating the trench.

4. The electrical connector as claimed in claim 3, wherein the housing further forms a bottom wall and two side walls perpendicularly connecting the bottom wall to cooperatively define the trench, each of the contacts further comprising an arcuate contacting portion extending upwardly from the retention portion.

5. The electrical connector as claimed in claim 4, the contact further comprises an orientation portion having at least one protrusion formed between the retention portion and the contacting portion for controlling the depth that the contact is into the housing.

6. A method for making an electrical connector for connecting an electrical device to a printed circuit board, comprising:

providing a dielectric housing having an outside face and a plurality of passageways arranged adjacent to the outside face, each of the passageways defining a mating surface generally parallel to the outside face;

providing a plurality of contacts, each of the contact forming a retention portion, the retention portion defining a retention face for engaging with the mating surface and at least one through hole in the center of the retention face;

inserting the contacts into the housing till the retention portion fits in the passageway; and stamping a line of dents on the outside face to extrude parts of the housing into the through holes to form projecting portions inside the passageways, wherein the projecting portions mate into the through holes, thereby securing of the contact in the housing.

7. The method as claimed in claim 6, wherein the housing further defines an inserting surface substantially perpendicular to the outside face and an mounting surface opposite to the inserting surface, each of the contacts further comprising an arcuate contacting portion extending upwardly to the inserting surface from the retention portion for contacting said electrical device.

8. The method as claimed in claim 7, wherein the housing further comprises a longitudinal trench in the inserting surface, the passageways arranged along and communicating the trench.

9. The method as claimed in claim 8, wherein the contact further comprises an orientation portion having at least one protrusion formed between the retention portion and the contacting portion.

10. An electrical connector for connecting an electrical device to a printed second cross-sectional dimension larger than the first cross-sectional dimension and the straight retention portion defining a third cross-sectional dimension smaller than the first dimension so that the contact is inserted into the corresponding passageway in a lengthwise direction defining by the passageway from the retention portion rather than the contact portion, the retention portion defining at least one through holes in a thickness direction thereof;

wherein the housing is punched to form at least one projecting portion inside the passageway from one side of the passageway, the at least one projecting portion mating into the at least one through hole to secure the contact in the housing without movement along said lengthwise direction under a condition that the projection portion defines two opposite ends along said thickness direction, and the projecting portion is integrally formed with the housing at only one of said two opposite ends.

11. The electrical connector as claimed in claim 10, wherein said at least one projecting portion fully occupies the corresponding through hole, contacting the other side of the passageway.

* * * * *